US010793299B2

(12) United States Patent
Gay et al.

(10) Patent No.: US 10,793,299 B2
(45) Date of Patent: Oct. 6, 2020

(54) METHOD AND UNIT FOR THE STERILE FILLING OF A FINAL BASIC CONTAINER WITH CONTENT INTENDED FOR THE BIOPHARMACEUTICAL FIELD

(75) Inventors: Isabelle Gay, Peypin (FR); Nicolas Mendyk, Peypin (FR)

(73) Assignee: SARTORIUS STEDIM FMT SAS, Aubagne (FR)

( * ) Notice: Subject to any disclaimer, the term of this patent is extended or adjusted under 35 U.S.C. 154(b) by 624 days.

(21) Appl. No.: 13/577,929

(22) PCT Filed: Feb. 9, 2011

(86) PCT No.: PCT/FR2011/050272

§ 371 (c)(1),
(2), (4) Date: Aug. 24, 2012

(87) PCT Pub. No.: WO2011/098724

PCT Pub. Date: Aug. 18, 2011

(65) Prior Publication Data

US 2012/0312415 A1 Dec. 13, 2012

(30) Foreign Application Priority Data

Feb. 10, 2010 (FR) ..... 10 50939

(51) Int. Cl.
*B65B 3/00* (2006.01)
*B65B 31/02* (2006.01)

(52) U.S. Cl.
CPC ..... *B65B 3/003* (2013.01); *B65B 31/02* (2013.01)

(58) Field of Classification Search
CPC ..... B65B 3/04; B65B 55/02; B65B 55/04; B65B 55/027; B65B 31/02; B65B 31/025;
(Continued)

(56) References Cited

U.S. PATENT DOCUMENTS 3,527,017 A * 9/1970 Bott et al. ..... 53/500
3,698,450 A * 10/1972 Taylor et al. ..... 141/85
(Continued)

FOREIGN PATENT DOCUMENTS

CH 420487 9/1966
DE 1129258 5/1962
(Continued)

OTHER PUBLICATIONS

English translation of Prioult (FR 2 853 522).*
(Continued)

*Primary Examiner* — Andrew D StClair
(74) *Attorney, Agent, or Firm* — Nixon & Vanderhye

(57) ABSTRACT

A method for the sterile filling of at least one final basic container, includes: providing at least one sterile chamber having at least one sterile entrance port and providing a source container containing the content, located outside the chamber; providing a communication element, a dispensing element and at least one filling member, to form when all are assembled, a sterile fluid filling and transfer line; inserting at least one final container into the chamber; structurally combining at least one final container with at least one filling member; providing inner members and elements in sterile condition for a single-use; inserting the inner element and members which were previously outside the chamber in the chamber in a sterile manner, such that after filling, a new filling process can be performed without sterilizing the inside of the chamber; transferring in a filling step content from the source container into the final container.

17 Claims, 6 Drawing Sheets

(58) Field of Classification Search
CPC ..... B65B 31/027; B65B 3/003; F24F 3/161; B25J 21/00; B25J 21/005; B25J 21/02; G21F 7/005
USPC ..... 141/2, 236, 237
See application file for complete search history.

(56) References Cited

U.S. PATENT DOCUMENTS

| | | | | |
|---|---|---|---|---|
| 3,899,862 | A * | 8/1975 | Muys et al. | 53/426 |
| 4,142,561 | A * | 3/1979 | Bennett et al. | 141/82 |
| 4,417,607 | A * | 11/1983 | Scholle et al. | 141/1 |
| 5,425,400 | A | 6/1995 | Szatmary | |
| 5,830,547 | A * | 11/1998 | MacKenzie et al. | 428/36.1 |
| 5,853,207 | A * | 12/1998 | Saint Martin | B01L 1/02 292/256.6 |
| 5,911,252 | A | 6/1999 | Cassel | |
| 5,947,296 | A | 9/1999 | Castora | |
| 6,357,488 | B1 | 3/2002 | Brossard et al. | |
| 7,146,781 | B1 | 12/2006 | Cole | |
| 8,071,009 | B2 * | 12/2011 | Py et al. | 264/328.11 |
| 8,087,596 | B2 | 1/2012 | Mennenga | |
| 2004/0139698 | A1 * | 7/2004 | Grifols Lucas | 53/426 |
| 2006/0064070 | A1 * | 3/2006 | Martin | 604/403 |
| 2007/0000573 | A1 * | 1/2007 | Py et al. | 141/329 |
| 2009/0094940 | A1 * | 4/2009 | Py | 53/267 |
| 2010/0175774 | A1 | 7/2010 | Mennenga | |
| 2011/0142574 | A1 | 6/2011 | Schnyder | |

FOREIGN PATENT DOCUMENTS

| | | | | |
|---|---|---|---|---|
| DE | 69412600 | | 6/1999 | |
| DE | 102006054606 | | 5/2008 | |
| DE | 102008019483 | | 10/2009 | |
| EP | 2279121 | | 2/2011 | |
| FR | 2853552 | A1 * | 10/2004 | A61L 2/26 |
| GB | 2237816 | | 5/1991 | |
| WO | 96/31392 | | 10/1996 | |
| WO | 0242156 | | 5/2002 | |
| WO | 2007/113661 | | 10/2007 | |
| WO | 2009127454 | | 10/2009 | |
| WO | 2009153676 | | 12/2009 | |

OTHER PUBLICATIONS

International Search Report dated Jun. 15, 2011, corresponding to PCT/FR2011/050272.
Opposition Brief, dated Mar. 23, 2015, in corresponding European Parent Application No. 11711610.3.
Opposition Brief, dated Mar. 17, 2015, in corresponding European Parent Application No. 11711610.3.
Opposition Brief, dated Mar. 24, 2015, in corresponding European Parent Application No. 11711610.3.
Opposition Brief, dated Mar. 18, 2015, in corresponding European Parent Application No. 11711610.3.
Mannheim Conference, Mar. 3-4, 2009, cover sheet, partial events calendar, presentation slides.
Venice Conference, Nov. 26-30, 2009, cover sheet, partial events calendar, presentation slides.
Nigel Bell, "End-to-End Deployment of Single-Use Technology in Aseptic Filling of Vaccines at GSK", Monge and Sinclair, BioPharm International, Presentation, Dec. 15, 2009.
Bioprocess International, "Managing Solid Waste from Single-Use Systems in Biopharmaceutical Manufacturing," Jan. 2009, pp. 18-24.
Bioprocess International, "Environmental impact of Single-Use and Reusable Bioprocess Systems," Feb. 2009, pp. 18-25.
Bioprocess International, "Guide to Disposal of Single-Use Bioprocess Systems," Nov. 2007, pp. 22-28.
Bioprocess International, "Introducting Disposable Systems into Biomanufacturing" Nov. 2008, pp. 30-36.
Bioprocess International, "Disposable Technologies for Aseptic Filling," Jun. 2006, pp. 48-51.
Biosafe Single Use Aseptic Transfer Systems, SartoriusStedium biotech Ver. 2/20090; http://www.sartorius.com/fileadmin/fm-dam/sartorius_media/BioprocessSolutions/Fluid_Management/Aseptic_Transfer_System/Brochures/Brochure_Biosafe_SPT1001-e.pdf.
Prevas Disposable Dosing System, Department, Mar. 5, 2008, http://www.hakoplan.net/kr/product/pdf/bosch/bosch)packaging_line/Prevas_Disposable_Dosing_System.pdf.
Technical drawings 709-03X and 709-04A, Paul Europe Limited, 2007.
Jim Furey, "Acerta Disposable Filling System," presentation, May 4, 2004.
Brigitte Lechiffre, Presentation "DPTE-BetaBag(R) for fluid transfer," Nov. 2008.
DPTE-S Transfer System, 2006.
Robert Luciano, "'Disposable' equipment revolutionizes new capabilities for aseptic filling," Food & Drug, Jul. 2002, pp. 52-53.
Miriam Monge et al., "End-to-End Deployment of Single-Use Technology in Aseptic Filling of Vaccines at GSK", Monge and Sinclair, BioPharm International, vol. 23, Issue 2, Feb. 1, 2010.
Giuseppe Paganini et al., "Single-Use Technologies Bring Flexibility to Final Filling Operations," BioProcess International, Nov. 2007.
Tender for one-way filling plant from Pall GmbH BioPharmaceuticals to Bausch+Sröbel [sic] of Jul. 7, 2009, countersigned Jun. 15, 2009 (pp. E1 to E4), witness Werner Wieland (countersigning responsible division manager of design/development at Bausch+Ströbel) and Andreas Bürkert (participant negotiations, directly responsible for receipt of tenders.
Ahmad J. Shahidi, "Major benefits of single-use systems in the Biopharmaceutical Industry: An Evolving Technology," Jun. 22, 2009.
Berlin Conference, Mar. 27, 2009, cover sheet, partial events calendar, presentation slides.

* cited by examiner

METHOD AND UNIT FOR THE STERILE FILLING OF A FINAL BASIC CONTAINER WITH CONTENT INTENDED FOR THE BIOPHARMACEUTICAL FIELD

BACKGROUND OF THE INVENTION

Field of the Invention

The invention relates to the field of the sterile filling of a final basic container with biopharmaceutical fluid that is originally located in a source container, also in a sterile manner.

According to a first aspect, the object of the invention is a process for the sterile filling of at least one final basic container with contents that can be distributed in a fluid form and that are originally located in a source container in a sterile manner.

According to a second aspect, the object of the invention is a unit for the sterile filling of at least one final basic container with contents that can be distributed in a fluid form and that are originally located in a source container in a sterile manner, especially designed for the implementation of the process according to the invention.

According to a third aspect, the object of the invention is an individual unit that is designed for the implementation of a filling process according to the invention and for the production of a sterile filling unit according to the invention.

According to a fourth aspect, the object of the invention is a sterile fluid transfer and filling line that is especially designed for a sterile filling unit of at least one final container with the contents that can be distributed in a fluid form according to the invention.

There is always a need in the biopharmaceutical field to implement processes and to produce filling units of a final basic container with a biopharmaceutical fluid in which the following are used: a number of parts such as containers, tubes or ports integrated into more or less complex units that can comprise several receptacles, several tubes, and several functional means, mated to one another.

Description of the Related Art

An example of a process for filling final containers with a biopharmaceutical fluid is given, by way of example, by the document WO-A1-2002/42156 that describes the installation of final containers that have a single opening head and a bottom head, in a decompression chamber; the generation of pressure that is lower than atmospheric pressure inside the decompression chamber; the introduction of a biopharmaceutical product contiguous to the opening heads of the final containers in this decompression chamber; the gradual release of pressure inside said decompression chamber to lead the biopharmaceutical product into the final containers; the removal of unused biopharmaceutical product, and the return of the final containers with their tops up; and then the sealing of the opening heads.

Other examples of the process for filling final containers are also described in the documents U.S. Pat. No. 5,911,252, WO-A2-2007/113661, WO-A1-1996/31392 and CH-A-420,487.

A biopharmaceutical fluid is conventionally defined as a fluid that is obtained from biotechnology—culture media, cellular cultures, buffer solutions, artificial nutrition liquids, blood products and derivatives of blood products—or a pharmaceutical fluid, or more generally a fluid that is designed to be used in the medical field.

More particularly, a process for the sterile filling of at least one final basic container with contents that can be distributed in a fluid form and that are originally located in a source container in a sterile manner is known from the state of the art, in which:

- A sterile chamber that has at least one sterile entry port and/or outlet is used, and the source container that contains the contents, located outside of the chamber, is used,
- Communication means, distribution means, and at least one sterile fluid filling element are used, forming, being all assembled, a sterile fluid transfer and filling line that has an intake and at least one outlet, and such a transfer and filling line is used or is formed such that for the filling stage, it goes through the wall of the chamber in a sterile manner, with the intake being located outside of the chamber and in sterile fluid communication with the source container, with at least one filling element, at the outlet, being located inside the chamber and positioned to be able to be operating, with one or more of the so-called internal means and elements being located substantially inside the chamber and one or more of the so-called external means and elements being located substantially outside of the chamber, including a so-called engaging communication pipe segment that is able to pass through the wall of the chamber in a sterile manner,
- At least one final container is introduced into the interior of the chamber in a sterile manner,
- For the purposes of filling, at least one final container is structurally mated to at least one filling element,
- In a filling stage, the contents of the source container are sampled, they are passed into the transfer and filling line, and the desired quantity is delivered into at least one final container.

Also known from the prior art is a sterile filling unit of at least one final basic container with contents that can be distributed in a fluid form and that are originally located in a source container in a sterile manner, comprising:

- A sterile chamber that has at least one sterile entry port and/or outlet,
- Communication means, distribution means, and at least one filling element, of the sterile fluid type, forming, being all assembled, a sterile fluid transfer and filling line that has an intake and at least one outlet.

Traditionally, such filling processes and units use stainless steel parts that are connected to one or more tubes made of plastic material or stainless steel and installed in a sterile chamber so as to compose the fluid transfer line. Thus, the major portion of the parts that form this fluid transfer line is provided inside the sterile chamber. However, so as to conform to the sterilization constraints imposed by the biopharmaceutical field, these processes necessitate using, before each filling operation, a certain number of maintenance, handling and/or sterilization operations on the parts that are used in the sterile chamber. More particularly, the stainless steel parts should be sterilized while the disposable parts should be manipulated so as to extract them from the sterile chamber. These maintenance operations are necessary to ensure that these parts meet the approval of the health authorities and are compatible with use in a clean room.

These embodiments therefore exhibit a certain number of limits and drawbacks. In particular, the maintenance operations exhibit the drawback of considerably increasing the time that is necessary between each filling operation since they necessitate, alternately or successively, extracting certain parts from the sterile chamber to replace them by other sterile parts and sterilizing the stainless steel parts that remain in place in this sterile chamber. In addition, the multiplication of these maintenance operations considerably increases the costs of production since these operations require the intervention of personnel for managing decontamination. These drawbacks are prohibitive when, as is increasingly often desired, the sterile chamber is to be used with high frequency to ensure a maximum production rate.

There is therefore an unsatisfied need to carry out a sterile filling of at least one final basic container with contents that can be distributed in a fluid form and that are originally located in a source container that makes it possible to obtain a disposable fluid transfer line that is adapted to the biopharmaceutical field and that therefore ensures a quality sterilization without prohibitive additional expenses and rapid assembly and disassembly operations.

BRIEF SUMMARY OF THE INVENTION

The invention has as its object to meet this need that corresponds to specific requirements of the biopharmaceutical field.

In this regard, according to a first aspect, the invention relates to a process for sterile filling of at least one final basic container with contents that can be distributed in a fluid form and that are originally located in a source container in a sterile manner, in which:

- A sterile chamber that has at least one sterile entry port and/or outlet is used, and a source container that contains the contents, located outside of the chamber, is used,
- Communication means, distribution means, and at least one filling element of the sterile fluid type, forming, being all assembled, a sterile fluid transfer and filling line that has an intake and at least one outlet, are used, and such a transfer and filling line is used or is formed such that for the filling stage, it goes through the wall of the chamber in a sterile manner, with the intake being located outside of the chamber and in sterile fluid communication with the source container, with at least one filling element, at the outlet, being located inside the chamber and positioned to be able to be operating, with one or more of the so-called internal means and elements being located substantially inside the chamber, and one or more of the so-called external means and elements being located substantially outside of the chamber, including a so-called engaging communication pipe segment that is able to pass through the wall of the chamber in a sterile manner,
- At least one final container is introduced inside the chamber in a sterile manner,
- For the purposes of filling, at least one final container is structurally mated to at least one filling element,
- In a filling stage, the contents of the source container are sampled, they are passed into the transfer and filling line, and the desired quantity is delivered into at least one final container,
- At least the internal means and elements are selected with overall dimensions that allow the passage through a door of the chamber and of a disposable type for the filling in question,
- In a stage prior to the filling stage, internal means and elements in the sterile state are used, with these means and elements being located outside of the chamber,
- In a subsequent stage for introduction into the chamber of internal means and elements, also prior to the filling stage, disposable internal means and elements that were previously located outside of the chamber are introduced into the interior of the chamber in a sterile manner,
- such that, once the filling is carried out, it is possible to initiate another filling without having to sterilize the interior of the chamber.

According to one embodiment, the disposable-type external means and elements are also selected for the filling in question.

According to one embodiment, in which the process is used for the filling of a unit of n final containers, each with the same quantity of contents:

- A unit of n final containers is used,
- p filling elements, a transfer and filling line having an intake and p outlets, with p being greater than or equal to n, are used,
- The n final containers are introduced into the chamber,
- The n final containers are structurally mated to n filling elements,
- And, in one and the same filling stage, the n final containers are filled.

According to one embodiment, in which the process is used for the filling of a unit of n final containers, each with the same quantity of contents:

- A unit of n final containers is used,
- p filling elements, a transfer and filling line that has an intake and p outlets, with p being less than or equal to n, are used,
- A number q1 of final containers is structurally mated to a number q1 of filling elements, with q1 being less than or equal to n,
- In a filling stage, the desired quantity of contents is delivered into each of the q1 final containers,
- The q1 final containers and the q1 filling elements are separated, and while keeping the previously used internal means and elements operating, the filling stage is repeated one or more times with numbers q2, q3, and qi of the final containers until n final containers are filled, with the internal means and elements being of the disposable type for the successive filling stages in question.

According to one embodiment, in a first phase, the sterile filling of at least one first final basic container with a first set of contents that is originally located in a first source container is initiated, and in a second phase, the sterile filling of at least a second final basic container with a second set of contents that is located originally in a second source container is initiated, and:

- In the first phase, a first transfer and filling line is formed, and after the filling stage, the at least one first final container and the at least one first filling element are separated,
- In the second phase, a second transfer and filling line is formed, and after the filling stage, the at least one second final container and the at least one second filling element are separated,
- And the operation moves from the first phase to the second phase without sterilizing the interior of the chamber again.

According to one embodiment, in a stage subsequent to the filling stage, the at least one filled final container is evacuated from the interior of the chamber to the exterior thereof in a sterile manner.

According to one embodiment, at least one final container and a source container such as the at least one final container has a capacity that is a fraction of the capacity of the source container.

According to one embodiment, the communication means are selected from the group that comprises pipes, tubes, hoses and the like; the distribution means are selected from the group that comprises pumps and the like; and the filling elements are selected from the group that comprises injection needles, nozzles, and the like.

According to one embodiment, the filling elements and the final containers are selected in such a way that originally, a filling element is either separated or is at least partially integrated into a final container.

According to one embodiment, a final container is selected from the group that comprises open or closed containers, vials, syringes, flasks and bottles, and pockets or a pocket system that may or may not be disposable.

According to one embodiment, in the stage prior to the filling stage, at least one other functional means or element is used that is designed to be integrated into the transfer and filling line, such as a filtering means, a buffer storage means, or a connection means, which, being assembled with communication means, distribution means and at least one filling element, form the sterile fluid transfer and filling line, and such a transfer and filling line is used or formed.

According to one embodiment, for the filling stage, at least one of at least one other functional means or element that is designed to be integrated into the transfer and filling line is a disposable means or element for the so-called external filling in question that is located outside of the chamber.

According to one embodiment, for the filling stage, at least one of at least one other functional means or element that is designed to be integrated into the transfer and filling line is a so-called internal means or element that is located inside the chamber, and:

The at least one of at least one other internal functional means or element of the disposable type is selected for the filling in question, In a stage that is prior to the filling stage, at least one of at least one other internal functional means or element is used, this internal functional means or element being located outside of the chamber, In a subsequent stage for introducing into the chamber at least one internal functional means or element, also prior to the filling stage, this internal functional means or element that is disposable and that was previously located outside of the chamber is introduced into the interior of the chamber, in a sterile manner.

According to one embodiment, at least communication means, distribution means and the at least one filling element are introduced and positioned to be able to be operating in the chamber.

According to one embodiment, the at least one of at least one other internal functional means or element that is disposable is introduced and positioned to be able to be operating in the chamber, also.

According to one embodiment, the filling stage or the repetition of filling stages includes at least one operation that consists in filling another container, such as a container for the purposes of testing, traceability or experimentation.

According to one embodiment, the operation for filling another container is carried out during the stage for filling one or more final containers.

According to one embodiment, in the stage prior to the filling stage where internal means and elements in the sterile state that are located outside of the chamber are used, at least one sterile individual unit is used, with internal means and elements comprising a sterile pocket of internal means and elements having a wall that limits a sterile inner space and that is equipped with an opening and an associated door that is complementary to a door of the chamber that can make possible, with the individual unit being mated to the chamber and the doors being in the open state, a sterile transfer of these internal means and elements between the inner space of the pocket and the interior of the chamber, with these internal means and elements in the sterile state being placed in the inner space of the pocket.

According to one embodiment, the process comprises a preliminary phase in which, using internal means and elements of a pocket of internal means and elements whose inner space is empty of these means and elements, at least one individual unit consists of internal means and elements, and for this purpose, these internal means and elements are placed in the inner space, the door of the pocket of the internal means and elements is brought into the closed state, and at least one individual unit is brought into the sterile state.

According to one embodiment, when at least one other functional means or element is used in the stage prior to the filling stage, this other functional means or element is placed in the inner space of the pocket of the internal means and elements.

According to one embodiment, a single sterile individual unit of internal means and elements is used for all of the internal means and elements.

According to one embodiment, in the stage prior to the filling stage where external means and elements are used in the sterile state that is located outside of the chamber including the engaging communication pipe segment, a sterile individual unit of external means and elements comprising a sterile pocket of external means and elements having a wall that limits a sterile inner space and that is equipped with an opening and an associated door that is complementary to a door of the chamber is used, which can make possible, with the individual unit being mated to the chamber and the doors being in the open state, a sterile transfer of these external means and elements between the inner space of the pocket and the interior of the chamber, whereby these external means and elements in the sterile state are placed in the inner space of the pocket.

According to one embodiment, the process comprises a preliminary phase in which, using external means and elements and a pocket of external means and elements whose inner space is empty of these means and elements, the individual unit consists of external means and elements, and for this purpose, these external means and elements are placed in the inner space, the door of the pocket of external means and elements is brought into the closed state, and the individual unit is brought into the sterile state.

According to one embodiment, at least one individual unit of external means and elements and an individual unit of different internal means and elements are used, and successively:

The at least one individual unit of internal means and elements is mated to the chamber, and the door of this individual unit and a door of the chamber are mated, and, after the doors are opened, a sterile transfer of these internal means and elements is carried out between the inner space of the pocket of internal means and elements and the interior of the chamber, The individual unit of external means and elements is mated to the chamber, and the door of this individual unit and a door of the chamber are mated, and, after the doors are opened, the end part that is downstream from the engaging communication pipe segment is introduced into the interior of the chamber, and the end part that is downstream from the engaging communication pipe segment is mated in sterile communication with the end part that is upstream from the internal means and elements.

According to one embodiment, before mating the door of the individual unit of external means and elements and the corresponding door of the chamber, the door of the at least one individual unit of internal means and elements and the corresponding door of the chamber are separated, with the latter being brought into the closed state, the door corresponding to the individual unit of external means and elements and the door corresponding to the individual unit of the internal means and elements being able to be the same door.

According to one embodiment, when the door of an individual unit with external means and elements is mated to the corresponding door of the chamber, the door of at least one individual unit of internal means and elements and the corresponding door of the chamber are kept mated, with the door corresponding to the individual unit of external means and elements and the door corresponding to the individual unit of internal means and elements being able to be different.

According to one embodiment, an individual unit of external means and elements and an individual unit of the same internal means and elements are used, and, successively, the door of the individual unit of internal and external means and elements and a door of the chamber are mated, and, after the doors are opened, a sterile transfer of internal means and elements is carried out between the inner space of the pocket of internal and external means and elements and the interior of the chamber, and the end part that is downstream from the engaging communication pipe segment is introduced into the interior of the chamber.

According to one embodiment, during the filling stage, the individual unit of internal means and elements and/or the individual unit of external means and elements mated to the chamber and the door(s) of the individual units of internal and/or external means and elements and of the chamber are kept in the open state.

According to one embodiment, with the individual unit of internal means and elements and/or the individual unit of external means and elements being mated to the chamber and the respective doors of the individual unit and the chamber being in the open state, the interior of the chamber and the inner space of the pocket of internal means and elements and/or the pocket of external means and elements are brought into communication, and a total space that comprises the inner space of the pocket of internal means and elements and/or the inner space of the pocket of external means and elements and the interior of the chamber are created with a larger volume than the volume of the interior of the chamber alone.

According to one embodiment, the constituent means and elements of the transfer and filling line include at least one external means or element with overall dimensions that do not allow passage through a door of the chamber.

According to one embodiment, before the introduction into the chamber of internal means and elements and at least one internal functional means or element, the different means and elements that are designed to be part of the transfer and filling line inside the chamber are all assembled with one another, and these thus assembled means and elements are introduced into the interior of the chamber.

According to one embodiment, before the introduction into the chamber of internal means and elements and at least one internal functional means or element, the different means and elements that are designed to be part of the transfer and filling line inside the chamber are all disassembled from one another, and these thus disassembled means and elements are introduced into the interior of the chamber and then are assembled with one another once they are located inside the chamber.

According to one embodiment, before the introduction into the chamber of internal means and elements and at least one internal functional means or element, a part of the different means and elements that are designed to be part of the transfer and filling line inside the chamber are assembled with one another and another part, disassembled from one another, the assembled means and elements are introduced into the interior of the chamber, thus assembled, the disassembled means and elements are introduced into the interior of the chamber, thus disassembled, and then are assembled with one another and with means and elements already assembled once they are located inside the chamber.

According to an embodiment before the filling stage, the different means and elements that are designed to be part of the transfer and filling line outside of the chamber are either all assembled with one another or all disassembled from one another, or some are assembled with one another, and others are disassembled from one another. These different means and elements are assembled for the filling stage.

According to one embodiment, before the filling stage, the end part that is downstream from the part of the transfer and filling line outside of the chamber and the end part that is upstream from the part of the transfer and filling line inside the chamber are either assembled with one another or disassembled from one another. These two parts of the transfer and filling line are to be assembled for the filling stage.

According to one embodiment, the final container(s) is/are introduced into the interior of the chamber and/or the other container(s) is/are introduced through a door of the chamber through which the internal means and elements and/or the at least one internal functional means or element are introduced into the chamber.

According to one embodiment, an individual unit of internal and/or external means and elements is used, and the final container(s) and/or the other container(s) are placed in the inner space of the pocket of such an individual unit and are introduced into the interior of the chamber from this individual unit that is mated to the chamber.

According to one embodiment, after the filling stage, in a stage for evacuation of the internal means and elements and at least one internal functional means or element that is used for the filling that is carried out, the internal means and elements and the at least one internal functional means or element is/are evacuated in a sterile manner from the interior of the chamber toward the exterior thereof.

According to one embodiment, an individual unit of internal and/or external means and elements is used, and for the evacuation of the chamber, the internal means and elements and the at least one internal functional means or element are introduced into the inner space of the pocket of such an individual unit, in that the same individual unit can be used for the introduction of these means and elements into the interior of the chamber and the evacuation of these means and elements from the chamber.

According to one embodiment, the process comprises several stages for introduction into the interior of the chamber of internal means and elements and/or several evacuation stages from the interior of the chamber of internal means and elements, combined with operations for connection or disconnection with the internal means and elements held in the chamber, before or after one or more filling stages, in such a way as to adapt the number of outlets of the transfer line during the implementation of the filling process, based on requirements.

According to a second aspect, the invention also relates to a sterile filling unit of at least one final basic container with contents that can be distributed in a fluid form and that are originally located in a source container in a sterile manner, especially designed for the implementation of the process according to the first aspect of the invention, comprising:

A sterile chamber that has at least one sterile entry port and/or outlet,

Communication means, distribution means, and at least one sterile fluid filling element, forming, being all assembled, a sterile fluid transfer and filling line that has an intake and at least one outlet, such that for the filling stage, it passes through the wall of the chamber in a sterile manner, with the intake being located outside of the chamber and in sterile fluid communication with the source container, with the at least one filling element, at the outlet, being located inside the chamber and positioned to be able to be operating, with one or more so-called internal means and elements being located substantially inside the chamber and one or more so-called external means and elements being located substantially outside of the chamber, including a so-called engaging communication pipe segment that is able to pass through the wall of the chamber in a sterile manner and whose downstream end part is able to be put into sterile communication with the end part that is upstream from the internal means and elements, with the internal means and elements having overall dimensions that allow passage through a door of the chamber and being disposable for the filling in question, And means that can introduce the disposable internal means and elements that, in a stage prior to the filling stage, were located outside of the chamber into the interior of the chamber in a sterile manner.

According to one embodiment, the external means and elements are also disposable for the filling in question.

According to one embodiment, the filling unit comprises p filling elements for n final containers, with p being greater than or equal to n, the filling unit being especially designed for the implementation of the process, in which:

A unit of n final containers is used, p filling elements are used, whereby a transfer and filling line has an intake and p outlets, with p being greater than or equal to n, n final containers are introduced into the chamber, The n final containers are mated structurally with n filling elements, And, in one and the same filling stage, the n final containers are filled.

According to one embodiment, the filling unit comprises p filling elements for n final containers, with p being less than or equal to n, the filling unit being especially designed for the implementation of the process according to the invention in which:

A unit of n final containers is used, p filling elements are used, whereby a transfer and filling line has one intake and p outlets, with p being less than or equal to n, A number q1 of final containers is structurally mated to a number q1 of filling elements, with q1 being less than or equal to n, In one filling stage, the desired quantity of contents is delivered into each of the q1 final containers, The q1 final containers and the q1 filling elements are separated, and while keeping the previously used internal means and elements operating, the filling stage is repeated one or more times with numbers q2, q3, qi of final containers, until the n final containers are filled, with the internal means and elements being disposable for the successive filling stages in question.

According to one embodiment, the communication means are selected from the group that comprises pipes, tubes, hoses and the like, and the distribution means are selected from the group that comprises pumps and the like.

According to one embodiment, a filling element is separated or at least partially integrated into a final container.

According to one embodiment, the filling unit also comprises at least one other functional means or element that is designed to be integrated into the transfer and filling line, such as a filtering means, a buffer storage means, or a connection means.

According to one embodiment, another functional means or element is disposable for the filling in question and is located inside the chamber.

According to one embodiment, another functional means or element is located outside of the chamber.

According to one embodiment, another external functional means or element is disposable for the filling in question.

According to one embodiment, the internal means and elements comprise at least communication means, distribution means, the at least one filling element, and, if necessary, the at least one other disposable internal functional means or element.

According to one embodiment, the filling unit also includes at least one sterile individual unit of internal means and elements comprising a sterile pocket of internal means and elements having a wall that limits a sterile inner space and that is equipped with an opening and an associated door that is complementary to a door of the chamber that can make possible, with the individual unit being mated to the chamber and the doors being in the open state, a sterile transfer of these internal means and elements between the inner space of the pocket and the interior of the chamber, with these internal means and elements in the sterile state being placed in the inner space of the pocket of internal means and elements.

According to one embodiment, the filling unit also comprises at least one other internal functional means or element, and the at least one other internal functional means or element is placed in the inner space of the pocket of internal means and elements.

According to one embodiment, the filling unit also includes at least one sterile individual unit of external means and elements comprising a sterile pocket of external means and elements having a wall that limits a sterile inner space and that is equipped with an opening and an associated door that is complementary to a door of the chamber that can make possible, with the individual unit being mated to the chamber and the doors being in the open state, a sterile transfer of these external means and elements between the inner space of the pocket and the interior of the chamber, with these external means and elements in the sterile state being placed in the inner space of the pocket of internal means and elements.

According to one embodiment, the filling unit includes an individual unit of external means and elements and an individual unit of internal means and elements, and, furthermore, the individual unit of external means and elements and the individual unit of internal means and units are different.

According to one embodiment, the filling unit includes an individual unit of external means and elements and an individual unit of internal means and elements and, furthermore, the individual unit of external means and elements and the individual unit of internal means and elements are the same.

According to one embodiment, the means and elements that constitute the transfer and filling line include at least one external means or element with overall dimensions that do not allow passage through a door of the chamber.

According to one embodiment, before the introduction into the chamber of internal means and elements and at least one internal functional means or element, the different means and elements that are designed to be part of the transfer and filling line inside the chamber are all assembled with one another.

According to one embodiment, before the introduction into the chamber of the internal means and elements and at least one internal functional means or element, the different means and elements that are designed to be part of the transfer and filling line inside the chamber are all disassembled from one another.

According to one embodiment, before the introduction into the chamber of the internal means and elements and the at least one internal functional means or element, a part of the different means and elements that are designed to be part of the transfer and filling line inside the chamber are assembled with one another and some are disassembled from one another.

According to one embodiment, before the filling stage, the different means and elements that are designed to be part of the transfer and filling line outside of the chamber are either all assembled with one another or all disassembled from one another, or some are assembled with one another and others are disassembled from one another.

According to one embodiment, before the filling stage, the end part that is downstream from the part of the transfer and filling line that is outside of the chamber and the end part that is upstream from the part of the transfer and filling line that is inside the chamber are all assembled with one another, or disassembled from one another, which are to be assembled for the filling stage.

According to one embodiment, the filling unit also comprises means for introducing—into the interior of the chamber—empty final containers and means for evacuation from the interior of the chamber of the filled final containers.

According to one embodiment, in the case where the filling unit includes an individual unit of internal and/or external means and elements, a pocket of such an individual unit is part of or constitutes the introduction means and/or the evacuation means of the final containers.

According to a third aspect, the invention relates to an individual unit that is designed for the implementation of a filling process according to the first aspect of the invention and the embodiment of a sterile filling unit according to the second aspect of the invention, in which the individual unit comprises:

A sterile pocket of internal means and elements having a wall that limits a sterile inner space and that is equipped with an opening and an associated door that is complementary to a door of the chamber that can make possible, with the individual unit being mated to the chamber and the doors being in the open state, a sterile transfer of the contents of the pocket to the interior of the chamber, And, placed in the inner space of the pocket, internal means and elements being part of the transfer and filling line, with overall dimensions that allow passage through a door of the chamber and of the disposable type for the filling in question.

According to one embodiment, the individual unit also includes at least one engaging communication pipe segment that is placed in the inner space of the pocket and at least one intake communication segment that is placed outside of the pocket, being part of the external means and elements.

According to one embodiment, the pocket also comprises a flexible wall or a rigid wall or a partially flexible and partially rigid wall.

According to one embodiment, the individual unit comprises at least one other means or functional element that is placed in the inner space of the pocket.

According to one embodiment, the different means and elements that are designed to be part of the transfer and filling line and that are located in the inner space of the pocket are originally either all assembled with one another or all disassembled from one another or some are assembled with one another and others are disassembled from one another.

According to one embodiment, one or more final containers are also placed in the inner space of the pocket.

According to one embodiment, the inner space of the pocket can accommodate the disposable internal means and elements after use for their evacuation.

According to a fourth aspect, the invention relates to a sterile fluid transfer and filling line that is especially designed for a sterile filling unit of at least one final container with contents that can be distributed in a fluid form, according to the second aspect of the invention, in which all or part of the means and elements of the transfer and filling line form, before assembly, an individual unit according to the third aspect of the invention.

BRIEF DESCRIPTION OF THE DRAWINGS

Several embodiments of the invention are now described using drawings, in which.

DETAILED DESCRIPTION OF THE PREFERRED EMBODIMENTS

Figure 1:
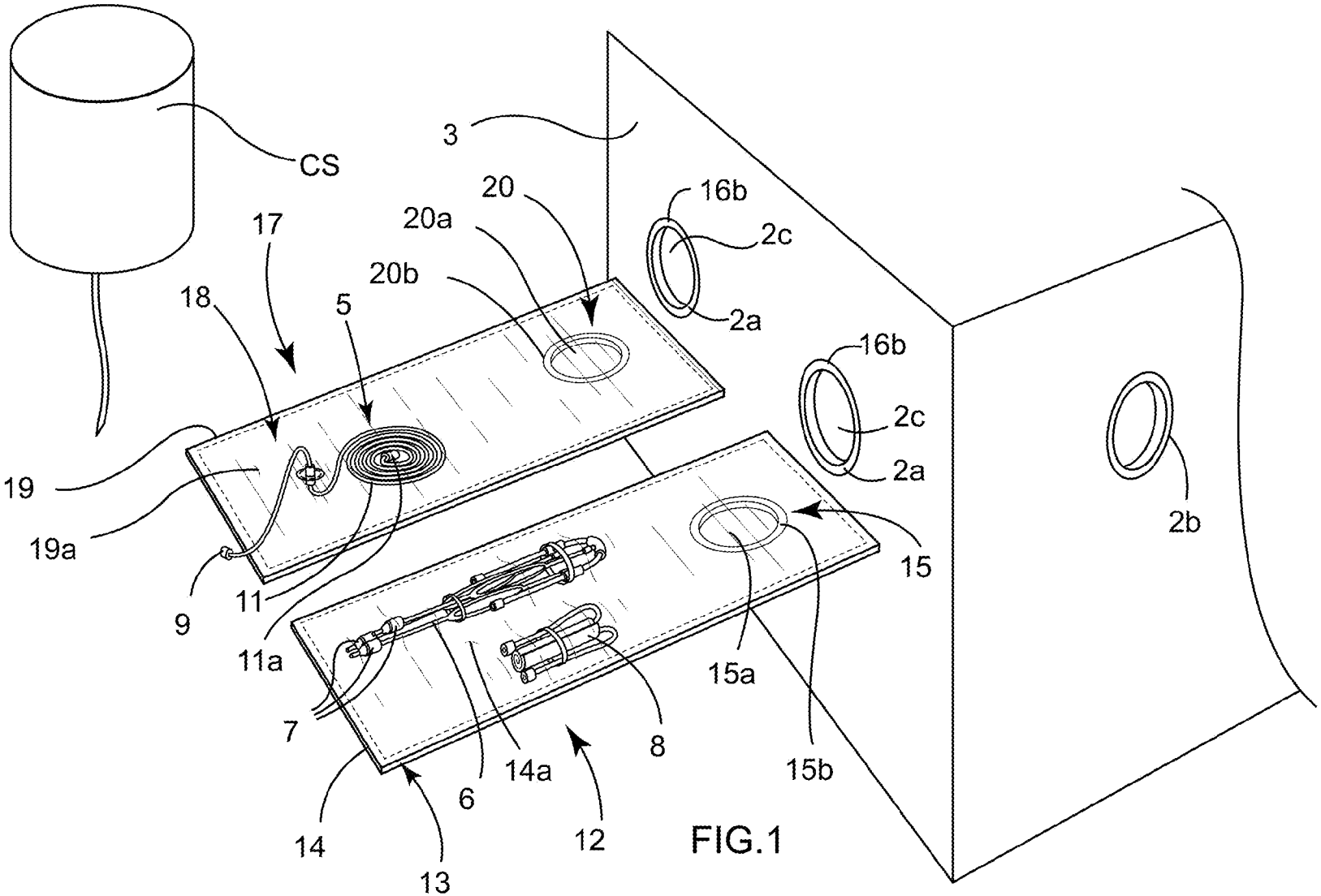
FIG. 1 is a perspective view of a first embodiment of the invention in which an individual unit of external means and elements and an individual unit of different internal means and elements are used for producing a sterile fluid transfer and filling line from contents that are originally located in a source container and up to one of the final containers that are located in a sterile chamber.
Figure 2:
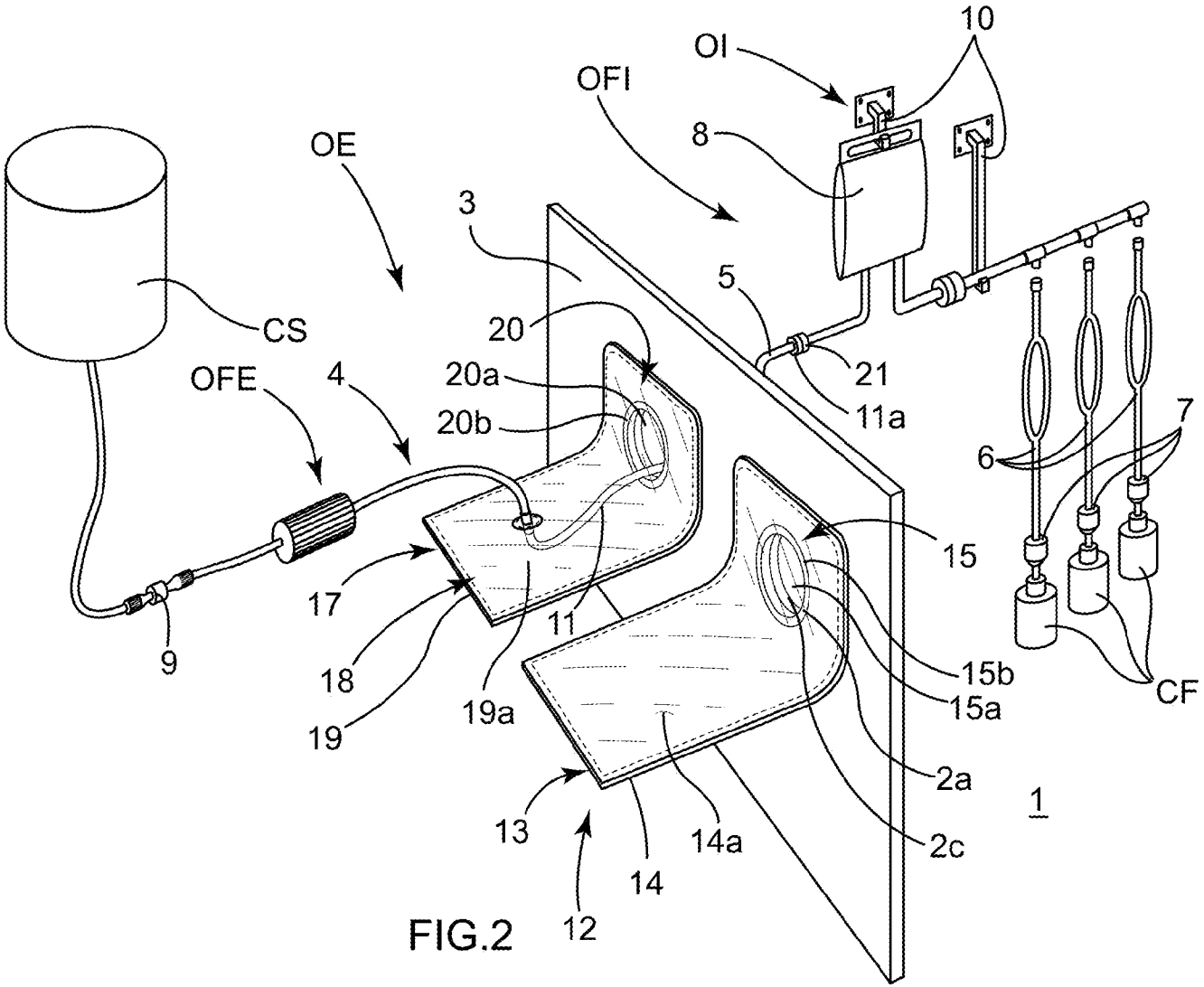
FIG. 2 is a perspective view of the first embodiment of the invention that is shown in FIG. 1, in which the internal means and elements that are originally located in the individual unit are arranged inside the sterile chamber, and the external means and elements are connected to the source connector.
Figure 3:
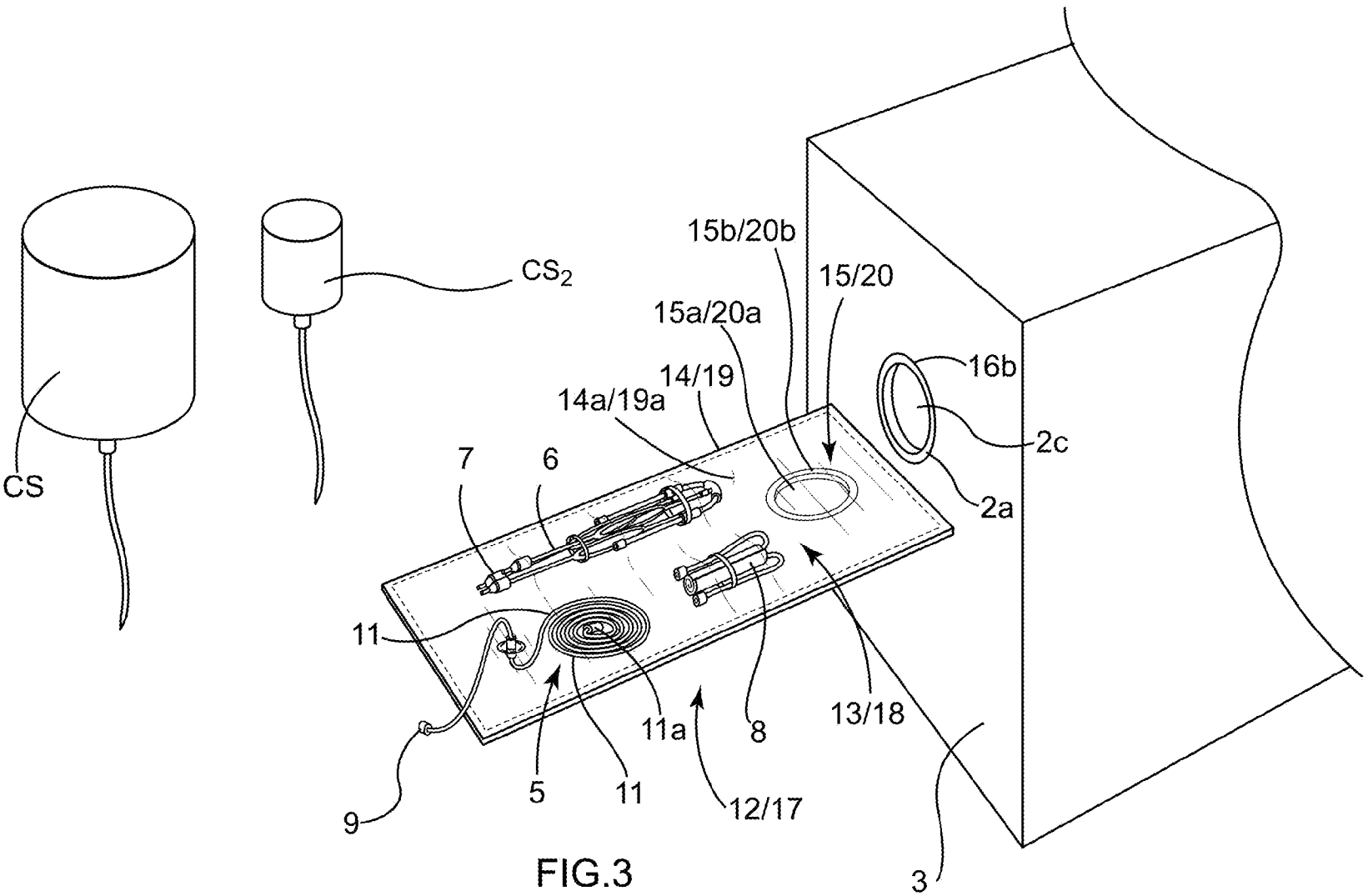
FIG. 3 is a perspective view of a second embodiment of the invention in which the individual unit of external means and elements and the individual unit of internal means and elements form a single individual unit that is used for producing a sterile fluid transfer and filling line from contents that are originally located in a source container and up to one of the final containers that are located in a sterile chamber.
Figure 4:
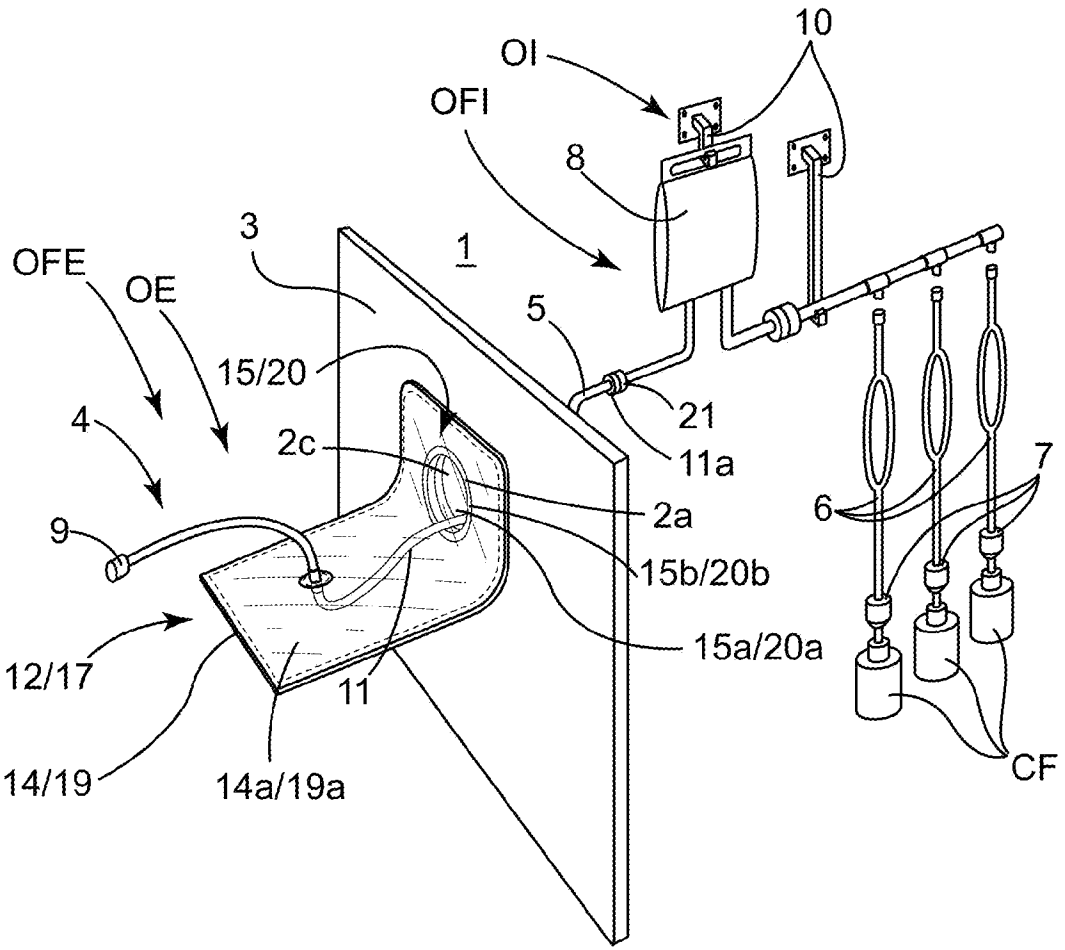
FIG. 4 is a perspective view of the embodiment of FIG. 3 in which the internal means and elements that are originally located in the individual unit are arranged inside the sterile chamber.
Figure 5:
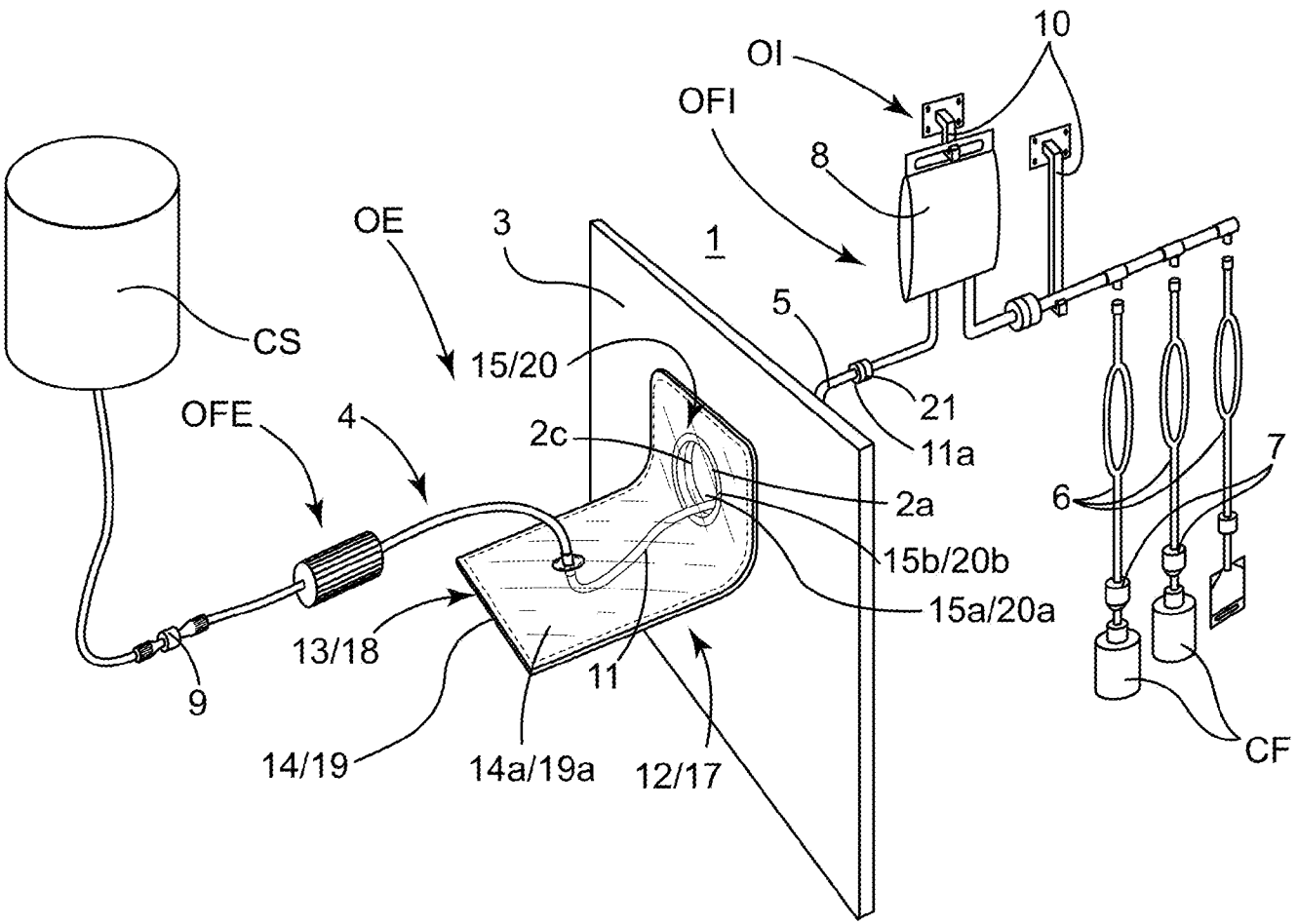
FIG. 5 is a perspective view of a third embodiment of the invention in which an individual unit of external means and elements and an individual unit of internal means and elements form a single individual unit that is used for producing a sterile fluid transfer and filling line from contents that are originally located in a source container and up to one of the final containers that is located in a sterile chamber, with the internal means and elements arranged inside the sterile chamber comprising two filling elements and a container for the purposes of testing, traceability, or experimentation.
Figure 6:
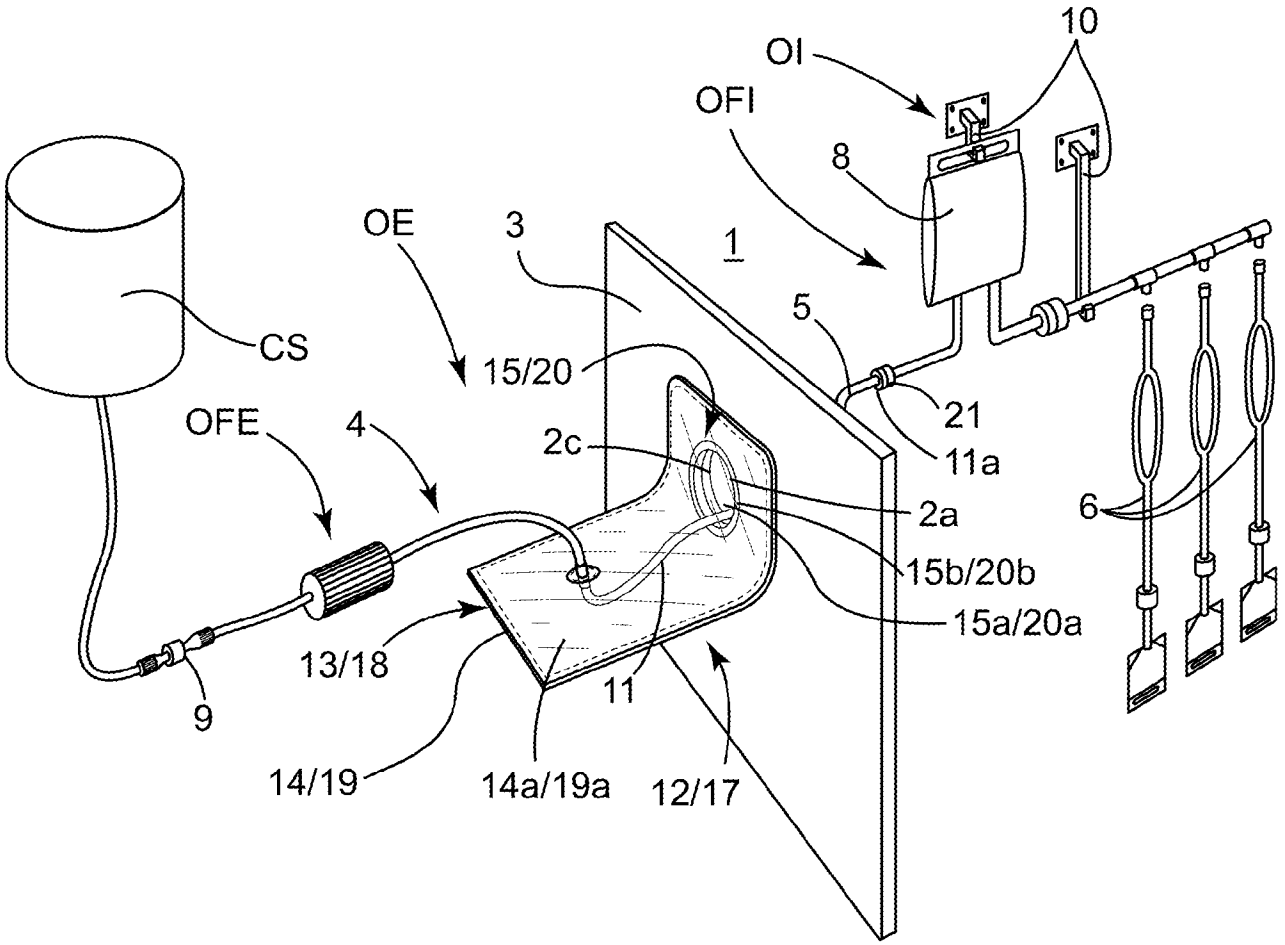
FIG. 6 is a perspective view of a third embodiment of the invention in which an individual unit of external means and elements and an individual unit of internal means and elements form a single individual unit that is used for producing a sterile fluid transfer and filling line from contents that are originally located in a source container and up to one of the final containers that is located in a sterile chamber, with the final containers here being disposable pockets.

The invention relates to the sterile filling of at least one—and in general a large number—of n final basic containers cf with contents that can be distributed in a fluid form and that are originally located in a source container CS in a sterile manner.

The invention pertains to the biopharmaceutical field; the contents in question are a biopharmaceutical fluid, as defined.

The source container CS can be a pocket that may or may not be flexible and whose volume can be larger or smaller, for example 20 liters to 500 liters or more.

The final container cf can be selected from the group that comprises open or closed containers, vials, syringes, flasks and bottles, and pockets or pocket systems that may or may not be disposable.

The final container cf has a capacity that is a fraction of the capacity of the source container, in particular that has a volume that can be very small.

The object of the invention is the sterile filling process in question, a sterile filling unit that is especially designed for the implementation of the process, an individual unit that, in one embodiment, is used in the process and included in the unit, and, finally, a transfer and filling line that is especially designed for such a sterile filling unit, comprising such an individual unit that is formed from all or part of the means and elements of the transfer and filling line.

The invention provides a sterile chamber 1, having at least one sterile entry port 2*a* and/or outlet 2*b*, mated to an opening 2*c* that is made in a wall 3 of the chamber 1. It involves structurally different doors or the same door that performs different functions, respectively for the introduction into the interior of the chamber 1 or for evacuation from the interior of the chamber 1.

Such a chamber 1 comprises one or more walls 3 that border it. Such a chamber can be large in size and have 3 rigid walls.

The source container CS is located outside of the chamber 1. For their filling, the final containers cf are located inside the chamber 1.

The invention provides a transfer and filling line 4 that is produced by the assembly in sterile communication with different means and elements: communication means 5, distribution means 6, filling elements 7, and, if necessary, one or more other functional means or elements 8.

The communication means 5 are typically selected from the group that comprises pipes, tubes, hoses and the like.

The distribution means 6 are typically selected from the group that comprises pumps and the like.

The filling elements 7 are typically selected from the group that comprises injection needles, nozzles, and the like.

Another functional means or element 8 is, for example, a filtering means, a buffer storage means, or a connection means. According to the embodiments, such a functional means or element 8 is either separated from a final container cf or is at least partly integrated into a final container cf. For example, a final container cf can be a closed pocket that includes intake means of the filling contents.

These different means and elements 5, 6, 7 and 8 are of the sterile fluid type.

The transfer and filling line 4 comprises, once produced, an intake 9 that is designed to be mated in sterile communication with the source container CS.

It comprises at least one outlet and most often a large number of outlets corresponding to a large number of p filling elements 7.

During a filling stage that will be referenced again, the transfer and filling line 4 passes through the wall 3 of the chamber in a sterile manner. The intake 9 is located outside of the chamber 1. The filling elements 7 are located inside the chamber 1 and positioned to be able to be operating relative to the final containers cf.

For this purpose, the chamber 1 is equipped with carrying means 10 of the means and elements 5, 6 and 7 of the transfer and filling line 4 that is located inside the chamber 4. Such carrying means 10 are, for example, hooks, brackets, and support pieces. They are of an adequate number to be able to accommodate any arrangement of the part of the transfer and filling line that is located in the chamber 1. They are positioned in the chamber 1 at any location that is suitable for their use. Such carrying means 10 are in a stationary position or are arranged to move, according to the desired flexibility requirements.

In the means and elements 5, 6 and 7, a distinction is made between so-called internal means and elements OI for the reason that they are located substantially inside the chamber 1 during the filling stage. A distinction is also made between so-called external means and elements OE for the reason that they are located substantially outside of the chamber 1. These external means and elements OE include a so-called engaging communication pipe segment 11 that is able to pass through the wall 3 of the chamber in a sterile manner, either because it passes through a door such as 2*a*, or otherwise.

In the functional means and element 8, it is possible to make the same distinction between so-called internal functional means and elements OFI and external functional means and elements OFE.

The process comprises a stage or operation in which the final container(s) cf is/are introduced into the interior of the chamber 1 in a sterile manner. It also comprises a stage or operation in which for filling purposes, the final containers cf are structurally mated to the filling elements 7. This structural mating is carried out in any suitable manner to make filling possible. As indicated above, it is provided that communication means 5, distribution means 6, and the internal filling elements 7, OI, are positioned in the chamber 1 so that they can be operating, thanks to carrying means 10.

The process also comprises a filling stage in which the contents of the source container CS are sampled, the contents are passed into the transfer and filling line that is then installed to be operating, and finally, the desired quantity is delivered into the final containers.

According to the invention, at least the internal means and elements OI are selected in such a way that, on the one hand, they have overall dimensions allowing the passage through a door such as 2*a*, and, on the other hand, they are disposable for the filling in question.

According to one embodiment, the external means and elements OE are also selected in such a way that they are of the disposable type for the filling in question.

According to one embodiment, other internal functional means or elements OFI are also selected in such a way that they have overall dimensions allowing the passage through a door such as 2*a* and they are disposable for the filling in question. And, if necessary, the external functional means and elements OFE of the disposable type are also selected for the filling in question.

In the process, in a stage prior to the filling stage, internal means and elements OI are used in the sterile state, which are then located outside of the chamber 1. Then, in a subsequent stage of introduction into the chamber 1 of these internal means and elements, OI, also prior to the filling stage, these internal means and elements OI are introduced into the interior of the chamber 1, in a sterile manner.

It follows that once the filling is completed, another filling can be initiated without having to sterilize the interior of the chamber, with the means and elements OI being evacuated in a sterile manner.

The invention can be viewed from several angles.

From a first possible angle, the purpose is to fill all of the n final containers cf, each with the same quantity of contents, in one and the same filling stage.

In this case, a unit of n final containers and p filling elements is used in such a way that the transfer and filling line 4 comprises an intake 9 and p outlets, with p being an integer that is greater than or equal to n.

Then, n final containers cf are introduced into the chamber 1.

Then, the n final containers cf are structurally mated to n filling elements 7.

And then the n final containers are filled.

This embodiment is well suited to the case of a limited number of final containers cf and therefore filling elements 7.

A second embodiment is well suited in the case of a larger number of final containers cf, while the number of filling elements 7 remains limited, with p being less than or equal to n.

With this second embodiment, several successive phases are initiated.

Thus, a number q1 of final containers cf is structurally mated to a number q1 of filling elements 7, with q1 being less than or equal to n, and, as indicated above, in a filling stage, the desired quantity of containers is delivered into each of the q1 final containers.

The q1 final containers cf and the q1 filling elements 7 can then be separated, and while keeping the previously used internal means and elements OI operating, the filling stage is repeated one or more times, respectively with numbers q2, q3, qi of final containers cf. In one embodiment, the numbers q1, q2, q3, and qi are identical. In other embodiments, if appropriate and as required, they are different.

The procedure is thus carried out up to filling the n final containers cf.

In this embodiment, the internal means and elements OI are also of the disposable type for the successive filling stages in question.

From a third angle, the process is such that, in a first phase, a first sterile filling of at least a first final basic container with first contents that are originally located in a first source container CS is initiated. Then, in a second phase, a second sterile filling of at least one second final basic container with second contents that are originally located in a second container source CS2 is initiated.

In the first phase, a first transfer and filling line such as 4 is formed, and after the corresponding filling stage, the first corresponding final containers and the first corresponding filling elements 7 are separated.

In the second phase, a second transfer and filling line of the same type as the first line 4 is formed, but adapted to the second filling, and, after the corresponding filling stage, the second corresponding final containers and the second corresponding filling elements 7 are separated.

Each phase corresponds to the complete filling process. Between the first phase and the second phase, consequently, the internal means and elements OI and OFI of the first transfer and filling line 4 are evacuated to the exterior of the chamber 1 from the interior of the chamber 1, and then, on the spot, the internal means and elements OI and OFI of the second transfer and filling line 4 are introduced into the chamber 1 and from the exterior thereof.

With such an embodiment, it is possible to pass from the first phase to the second phase without sterilizing the interior of the chamber 1 again.

The process also comprises a stage subsequent to the filling stage in which the filled final containers cf are evacuated from the interior of the chamber 1 toward the exterior thereof, in a sterile manner.

From another angle, the procedure for the other internal functional means or elements OFI is carried out in a manner that is analogous to the internal means and elements OI.

According to a possible embodiment, the filling stage or the repetition of filling stages includes at least one operation that consists in filling a container that is different from the final containers cf. Such another container ca can be a container for the purposes of testing, traceability or experimentation. In one embodiment, the filling operation of such another container ca is carried out during the filling stage of one or more final containers cf. In this case, one or more filling elements are especially dedicated to such another container(s) ca.

The sterile filling unit according to the invention comprises the sterile chamber 1, the transfer and filling line 4, and its different means and elements: communication means 5, distribution means 6, filling elements 7, other functional means or elements 8, and also means that can introduce the internal means and elements OI in a sterile manner into the interior of the chamber 1, and, if necessary, the disposable internal functional elements and means OFI that, in a stage prior to the filling stage, were located outside of the chamber 1.

According to a development of the invention, it is provided that in the stage prior to the filling stage, whereas the internal means and elements in the sterile state are located outside of the chamber, a so-called sterile individual unit 12 of internal means and elements is available.

Such an individual unit 12 comprises a so-called sterile pocket 13 of internal means and elements.

The pocket 13 has a wall 14 that limits a sterile inner space 14*a*.

This wall 14 is equipped with a door 15 that is mated to an opening 15*a* of the wall 14. The door 15 is complementary to the door 2*a*, 2*b* of the chamber 1.

The door 15 includes a flange 15*b* for removable rigid mating with the chamber 1, itself equipped with a corresponding flange 16*b* that is part of the door 2*a*, 2*b*. The two flanges 15*b* and 16*b* are complementary and can be mated rigidly and removably, thanks to mating means and maneuvering means provided for this purpose. Such mating means and such maneuvering means can comprise systems with complementary lugs and grooves, cams and levers or the like, for example. Thus, the individual unit 12 can itself be mated in a rigid and removable manner with the chamber 1, toward the exterior thereof, with the respective doors 15 and 2*a*, 2*b* mating.

The door 15 also includes a movable panel (not shown) between a closed state where it works in a complementary manner with the flange 15*b* by closing the opening 15*a* and an open state where it is released from the flange 15*b* by leaving the opening 15*a* open.

The door 2*a*, 2*b* itself also includes a movable panel between a closed state where it works in a complementary manner with the flange 16*b* by closing the opening 2*c* and an open state where it is released from the flange 16*b* by leaving the opening 2*c* open.

Means for maneuvering the panel of the door 2*a*, 2*b*, which opens toward the interior of the chamber 1, are provided. Such maneuvering means can comprise joints, levers, motors, or the like, for example.

Rigid and removable mating means of the panel are also provided on the panel of the door 2*a*, 2*b* in such a way that the movement of the latter ensures the same concomitant movement of the latter. Such mating means can comprise magnetic devices or the like, for example.

Thus, once the individual unit 12 is mated to the chamber 1, the panels of the doors 2*a*, 2*b* and 15 being in the closed state and their mated panels, it is possible to maneuver the panel of the door 2*a*, 2*b* to open it and to bring it into the open state, with the panel being open simultaneously and released from the flange 15*b*. In this situation, the inner space 14*a* of the pocket 13 is in communication with the interior of the chamber 1, and it is possible to operate a transfer from one to the other, either to introduce something that was located in the inner space of the pocket 13 into the interior of the chamber 1, or, conversely, to evacuate something that was located inside of the chamber 1 and to bring it into the inner space of the pocket 13.

The mating of the individual unit 12 and the chamber is produced in a sterile manner, in such a way that the transfer of introduction or evacuation in question is itself also sterile.

The individual unit 12 comprises, in addition to the pocket 13, the internal means and elements OI, and, if necessary, when they exist, the internal functional means and elements OFI. It is for this reason that the individual unit 12, like the pocket 13, can be so-called "internal means and elements." The means and elements OI and OFI are in the sterile state and are placed in the inner space 14*a* of the pocket 13.

According to one embodiment, such an individual unit 12 can be made in advance, independently of the filling process. Such an individual unit can be stored, transported and used as needed.

According to another embodiment, such an individual unit 12 is produced within the very framework of the filling process. In this case, the filling process comprises a preliminary phase in which, using internal means and elements OI and, if necessary, when internal functional means or elements OFI and a pocket 13 are provided, the individual unit 12 is composed, and for this purpose, these internal means and elements OI, OFI are placed in the inner space 14*a*, with the door 15 then being in the open state, and then the door 15 is brought into the closed state.

In one and the other of the embodiments, the individual unit 12 is brought into the sterile state, for example by a treatment with γ-rays or the like.

If necessary, several such individual units 12 are used for the same filling sequence, for example if the total overall dimensions of the internal means and elements OI, OFI is larger than the inner space of a single pocket 13.

According to another development of the invention that can be combined with the preceding one, it is provided that in the stage prior to the filling stage, a so-called sterile individual unit 17 of external means and elements is available.

Such an individual unit 17 comprises a so-called sterile pocket 18 of external means and elements.

The pocket 18 has a wall 19 that limits a sterile inner space 19*a*.

This wall 19 is equipped with a door 20 that is mated to an opening 20*a* of the wall 19. The door 20 is complementary to the door 2*a*, 2*b* of the chamber 1.

The door 20 includes a flange 20*b* for removable rigid mating with the chamber 1. The two flanges 20*b* and 16*b* are complementary and can be mated in a rigid and removable manner, thanks to mating means and maneuvering means provided for this purpose, as above. Thus, the individual unit 17 can itself be mated in a rigid and removable manner to the chamber 1, toward the exterior thereof, with the respective doors 20 and 2*a*, 2*b* mating.

The door 20 also includes a panel (not shown) that can move between a closed state where it works in a complementary manner with the flange 20*b* by closing the opening 20*a* and an open state where it is released from the flange 20*b* by leaving the opening 20*a* open.

Means for rigid and removable mating of the panel on the panel of the door 2*a*, 2*b* are also provided in such a way that the movement of the former ensures the same concomitant movement of the latter.

Thus, once the individual unit 17 is mated to the chamber 1, with the panels 2*a*, 2*b* and 20 being in the closed state and their mated panels, it is possible to maneuver the panel of the door 2*a*, 2*b* for opening it and bringing it into the open state, with the panel being opened simultaneously and released from the flange 20*b*. In this situation, the inner space 19*a* of the pocket 18 is in communication with the interior of the chamber 1, and it is possible to perform a transfer from one to the next, in a manner that is analogous to that which was seen for the individual unit 12.

The mating of the individual unit 17 and the chamber is produced in a sterile manner, in such a way that the introduction or evacuation transfer in question is itself also sterile.

In addition to the pocket 18, the individual unit 17 comprises the external means and elements OE, including the engaging communication pipe segment 11, and, if necessary, when they exist, the external functional means or elements OFE. It is for this reason that the individual unit 17, just like the pocket 18, can be the so-called "external means and elements." The means and elements OE and OFE are in the sterile state and are placed in the inner space 19*a* of the pocket 18.

According to one embodiment, such an individual unit 17 can be produced in advance, independently of the filling process. According to another embodiment, such an individual unit 17 is produced with the very framework of the filling process, in an analogous manner to what was disclosed for the individual unit 12. Also, as for the individual unit 12, the individual unit 17 is brought into the sterile state.

According to the embodiments, a pocket 13, 18 comprises a flexible wall, for example a film made of plastic material, or a rigid wall, or a wall that is partially flexible and partially rigid.

According to a first possible embodiment, the individual unit of the internal means and elements 12 and the individual unit of the external means and elements 17 are two structurally different units.

In such a case, the individual unit of the internal means and elements 12 is mated to the chamber 1, and as disclosed above, a sterile transfer of the internal means and elements OI and OFI is produced between the inner space 14*a* of the pocket 13 of internal means and elements and the interior of the chamber 1.

In contrast, the individual unit of the external means and elements 17 is mated to the chamber 1, and, after the doors 2*a*, 2*b*, 20 are opened, the end part 11*a* that is downstream from the engaging communication pipe segment 11 is introduced into the interior of the chamber 1, and it is mated in sterile communication with the end part 21 that is upstream from the internal means and elements OI.

According to a first possible embodiment, before mating the door 20 of the individual unit of external means and elements 17 and the corresponding door 2*a*, 2*b* of the chamber 1, the door 15 of the individual unit of internal means and elements 12 and the corresponding door 2*a*, 2*b* of the chamber 1, which is brought into the closed state, are separated.

With such an embodiment, the door 2*a*, 2*b* of the chamber 1 corresponding to the individual unit 12 and the door 2*a*, 2*b* of the chamber 1 corresponding to the individual unit 17 can be the same door.

According to a second possible embodiment, when the door 20 of the individual unit 17 and the corresponding door 2*a*, 2*b* of the chamber 1 are mated, the door 15 of the individual unit 12 is kept mated to the corresponding door 2*a*, 2*b* of the chamber 1.

With such an embodiment, the door 2*a*, 2*b* of the chamber corresponding to the individual unit 12 and the door 2*a*, 2*b* of the chamber 1 corresponding to the individual unit 17 can be different.

According to a second possible embodiment, the individual unit of the internal means and elements 12 and the individual unit of the external means and elements 17 form one and the same common unit 12/17. In this case, this unit 12/17 comprises a single pocket 13/18, a single wall 14/19, a single inner space 14*a*/19*a*, a single door 15/20, a single opening 15*a*/20*a*, a single flange 15*b*/20*b*, and a single panel.

With such an individual unit 12/17, the procedure is like this. The door 15/20 and the door 2*a*, 2*b* of the chamber 1 are mated, and then, after the doors 15/20 and 2*a*, 2*b* are opened, a sterile transfer of internal means and elements OI, and, if necessary, OFI, is performed between the inner space 14*a*/19*a* of the pocket 13/18 and the interior of the chamber. In one embodiment, the end part 11*a* that is downstream from the engaging communication pipe segment 11 is introduced into the interior of the chamber, and it is mated in sterile communication with the upstream end part 21 if the latter were not assembled in advance. In another embodiment, these end parts 11*a* and 21 are preassembled in sterile communication in such a way that it is not necessary to have to assemble them later.

According to another possible embodiment, during the filling stage, the individual unit 12 and/or 17 mated to the chamber 1 and the door(s) 15, 20 are kept in the open state. Thus, the interior of the chamber 1 and the inner space 14*a* and/or 20*a* are brought into communication. By so doing, a total space that comprises the inner space 14*a* and/or 20*a* of the pocket 14 and/or 20 and the interior of the chamber 1 are produced. This inner space therefore has a larger volume than the inside threshold volume of the chamber 1. Thanks to one or to both individual units 12, 17, it is possible to increase the space of the chamber 1.

The process that was just described makes it possible to implement one or more means or elements of overall dimensions that do not allow its or their passage through a door 2*a*, 2*b* of the chamber 1, but that is/are necessary for the filling. Such bulky means or elements are external and placed outside of the chamber 1, if necessary by being housed in a pocket 13, 18.

According to a first possible embodiment, before the introduction of the internal means and elements OI, if necessary OFI, into the chamber 1, the different means and elements OI, OFI, designed to be part of the transfer and filling line 4 inside the chamber 1, are all assembled with one another. Assembled is defined as connected in such a way as to communicate in a sterile manner. These means and elements OI, OFI that are thus assembled are introduced into the interior of the chamber 1.

According to a second possible embodiment, the different means and elements OI, OFI are all disassembled from one another. In this case, these thus disassembled means and elements OI, OFI are introduced into the interior of the chamber 1 and then are assembled with one another once located inside the chamber 1.

According to a third possible embodiment, some of the different means and elements OI, OFI are assembled with one another, and others are disassembled from one another. In this case, the assembled means and elements OI, OFI are introduced into the interior of the chamber 1, thus assembled; the disassembled means and elements OI, OFI are introduced into the interior of chamber 1, thus disassembled, and then are assembled with one another and with the means and elements OI, OFI already assembled once located inside the chamber 1.

According to another aspect and according to different possible embodiments, before the filling stage, the different means and elements OE, OFE that are designed to be part of the transfer and filling line 4 outside of the chamber 1 are either all assembled with one another, or all disassembled from one another, or some are assembled with one another and others are disassembled from one another.

Of course, these different means and elements are to be assembled for the filling stage.

According to the embodiments, the end part 11*a* that is downstream from the part of the transfer and filling line 4 to the exterior of the chamber, and the end part 21 that is upstream from the part of the transfer and filling line 4 to the interior of the chamber are either assembled with one another or disassembled from one another. Of course, these two end parts are to be assembled for the filling stage.

The sterile filling process and the sterile filling unit are provided in such a way as to be able, on the one hand, prior to the filling stage, to introduce into the interior of the chamber 1, from the exterior thereof, the final containers cf and/or the other empty container ca, and, on the other hand, after the filling stage, to evacuate from the interior of the chamber 1 to the exterior thereof the final containers cf and/or the other filled container ca.

This introduction, this evacuation can be done by means of one or more doors (or airlocks) of the chamber 1. In particular, this introduction, this evacuation can be done by means of one or more doors through which the internal means and elements OI and, if necessary, OFI, are introduced into the chamber or through which the contents from the source container CS up to the final container cf are introduced.

If necessary, advantage can be taken of using an individual unit such as 12 or 17 in the filling process so that this individual unit 12, 17 is also used functionally for the introduction of the final containers cf and/or the other empty container ca. In such a case, such empty containers cf and/or ca are placed in the inner space 14*a*, 19*a* of the pocket 13, 18 to be introduced into the interior of the chamber 1 from the individual unit 12 or 17 that is mated to the chamber 1. Such an embodiment generally can be considered only for a small number of containers or containers of small overall dimensions.

The sterile filling process and the sterile filling unit are provided in such a way as to be able, after the filling stage, to evacuate from the interior of the chamber 1 to the exterior thereof the internal means and elements OI and, if necessary, OFI once they have been used for the filling considered, once it is terminated, and require being replaced by others, also disposable for another filling.

This evacuation can be done by means of one or more doors of the chamber 1 and in particular by means of one or more doors through which the internal means and elements OI and, if necessary, OFI, were previously introduced into the chamber or through which the contents from the source container CS up to the final containers cf were introduced.

As above, it is also possible to take advantage of the implementation in the filling process of an individual unit such as 12 or 17 so that this individual unit 12, 17 is also used functionally for the evacuation of internal means and elements OI, and, if necessary, OFI.

If necessary, the same individual unit 12, 17 is implemented for the introduction of the means and elements OI, OFI into the interior of the chamber 1 and the evacuation of these means and elements OI, OFI from the interior of the chamber 1.

Thus, a pocket 13, 18 of an individual unit 12, 17 can be part of or constitute the means for introduction and/or the means for evacuation of the containers cf and ca and are part of or constitute the means for introduction and/or the means for evacuation of the means and elements OI, OFI.

The described process makes possible the greatest flexibility, not only for allowing the filling of one or more other containers ca, but also so as to adapt the number of filling elements 8 to the requirements, either to increase it or to reduce it.

For this purpose, the filling process can comprise several stages for introduction into the interior of the chamber 1 of internal means and elements OI, OFI and/or several stages for evacuation from the interior of the chamber 1 of internal means and elements OI, OFI. These stages are then combined with operations for connecting or disconnecting the means and elements that are introduced or evacuated with the internal means and elements that are kept in the chamber 1. These operations can, as needed, take place before or after one or more filling stages.

The word "sterile" as it is used is to be understood to mean free of microbial germs, viruses or other bodies, objects or products that are undesirably toxic, according to the usages of the field of application in question.

The invention provides disposable means and elements. Such means and elements are, for example, made of plastic.

The expression "chamber" or "sterile chamber" is to be understood as including clean rooms and related controlled environments taking into account the air quality, as it is defined in the Standard ISO 14644 or the Standard USP, Chapter 16.

The invention claimed is:

1. A process for the sterile filling of at least one final container with a content that can be distributed in a fluid form, said process comprising:

providing a sterile chamber that has a wall and at least one sterile entry door;

providing a source container that contains a content in a sterile manner and which is located outside of the chamber;

providing at least one final container which is located outside of the chamber;

providing elements which are located outside of the chamber, the elements comprising i) at least one communication element, ii) at least one distribution element, and iii) at least one sterile filling element, forming, when being all assembled, a sterile fluid transfer and filling line that has an intake and at least one outlet, the elements being divided into one or more elements being i) external elements to be located outside of the chamber when the fluid transfer and filling line is assembled and during a filling stage, ii) internal elements to be located inside the chamber when the fluid transfer and filling line is assembled and during the filling stage, and iii) an engaging communication pipe segment that is initially exterior to the chamber and that passes through the wall of the chamber in a sterile manner when the fluid transfer and filling line is assembled and during the filling stage, the internal elements being disposable for the intended filling;

providing a sterile individual unit which is located outside of the chamber, the sterile individual unit comprising a sterile pocket having a wall that limits a sterile inner space and that is equipped with an opening and an associated door that is complementary to the entry door of the chamber, the sterile inner space of the pocket comprising the internal elements arranged in a sterile state, the sterile individual unit also comprising the engaging communication pipe segment that is placed into the sterile inner space of the pocket and an intake communication segment that is placed outside of the pocket, the intake communication segment being an external element;

mating the sterile individual unit to the chamber;

with the entry door of the chamber and the door of the pocket being in the open state, transferring the internal elements between the sterile inner space of the pocket and the interior of the chamber in a sterile manner, the internal elements having overall dimensions that allow passage through the entry door of the chamber, the internal elements being introduced into the interior of the chamber as an assembled unit, an end part that is downstream from the engaging communication pipe segment being preassembled with an end part that is upstream from the internal elements;

arranging the transfer and filling line such that the transfer and filling line goes through the wall of the chamber in a sterile manner, with the intake of the transfer and filling line being located outside of the chamber and in sterile fluid communication with the source container;

the at least one filling element at the at least one outlet of the transfer and filling line, being located inside the chamber and positioned to be able to be operating;

introducing the at least one final container into the chamber in a sterile manner;

structurally mating the at least one final container to the at least one filling element at the at least one outlet of the transfer and filling line;

in the filling stage, sampling the content of the source container, passing the content of the source container into the transfer and filling line, and delivering a desired quantity of the content into the at least one final container;

once the filling is carried out, evacuating the internal elements in a sterile manner from the chamber, allowing initiating another filling without having to sterilize the interior of the chamber;

wherein:

i) in a first phase, the at least one final container is a first final container and the at least one filling element is a first filling element, a first transfer and filling line is formed, the sterile filling of the first final container is initiated with a first content that is originally located in a first source container, and after the filling stage, the at least one first final container and the at least one first filling element are separated, ii) in a second phase, the at least one final container is a second final container and the at least one filling element is a second filling element, a second transfer and filling line is formed, the sterile filling of the second final container is initiated with a second content that is originally located in a second source container, and after the filling stage, the at least one second final container and the at least one second filling element are separated, and iii) the operation moves from the first phase to the second phase without sterilizing the interior of the chamber again.

2. The sterile filling process according to claim 1, wherein the external elements and the engaging communication pipe segment are disposable for the intended filling.

3. The sterile filling process according to claim 1, wherein the at least one final container has a capacity that is a fraction of the capacity of the source container.

4. The sterile filling process according to claim 1, wherein after the filling stage, the at least one filled final container is evacuated from the inside of the chamber to the outside thereof, in a sterile manner.

5. The sterile filling process according to claim 1, wherein the at least one communication element, the at least one distribution element, and the at least one filling element are introduced and positioned to be able to be operating in the chamber.

6. The sterile filling process according to claim 1, further comprising a preliminary phase in which the inner space of the pocket is empty of the internal elements, then the internal elements are placed in the inner space of the pocket, the door of the pocket being brought into the closed state and the sterile individual unit being brought into the sterile state.

7. The sterile filling process according to claim 1, wherein, prior to the filling stage, the external elements and the engaging communication pipe segment are either all assembled with one another or all disassembled from one another, or some are assembled with one another and others are disassembled from one another, and during the filling stage, the external elements and the engaging communication pipe segment are assembled together.

8. The sterile filling process according to claim 1, wherein after the filling stage, in a stage for evacuating the internal elements, the internal elements are evacuated in a sterile manner from the interior of the chamber toward the exterior thereof.

9. The sterile filling process according to claim 1, wherein, the at least one communication element is a pipe, a tube, or a hose, the at least one distribution element is a pump, and the at least one filling element is an injection needle or a nozzle.

10. The sterile filling process according to claim 1, wherein the at least one final container is at least one of an open container, a closed container, a vial, a syringe, a flask, a bottle, a pocket, and a pocket system that may or may not be disposable.

11. The sterile filling process according to claim 1, wherein in a stage prior to the filling stage, at least one other functional element is provided that is designed to be integrated into the transfer and filling line, the at least one other functional element is a filtering element, a storage element, or a connection element, which, when being assembled with the at least one communication element, the at least one distribution element and the at least one filling element, form the transfer and filling line.

12. The sterile filling process according to claim 11, wherein the at least one other functional element is an internal element, and wherein:

the at least one other internal functional element is disposable for the intended filling, in a stage prior to the filling stage, the at least one other internal functional element is located outside of the chamber, in a subsequent stage for introducing into the chamber the at least one internal functional element, also prior to the filling stage, the at least one internal functional element that is disposable and that previously was located outside of the chamber is introduced into the interior of the chamber, in a sterile manner.

13. The sterile filling process according to claim 1, wherein the at least one communication element is a pipe, a tube, or a hose.

14. The sterile filling process according to claim 1, wherein the at least one distribution element is a pump.

15. The sterile filling process according to claim 1, wherein the at least one filling element is an injection needle or a nozzle.

16. The sterile filling process according to claim 1, wherein the at least one communication element is a pipe, a tube, or a hose, and wherein the at least one distribution element is a pump.

17. The sterile filling process according to claim 1, wherein the at least one distribution element is a pump, and wherein the at least one filling element is an injection needle or a nozzle.

* * * * *